US008671708B2

(12) United States Patent
Jeong

(10) Patent No.: US 8,671,708 B2
(45) Date of Patent: Mar. 18, 2014

(54) ICE STORAGE DEVICE AND REFRIGERATOR INCLUDING THE SAME AND A WATER PURIFIER INCLUDING THE SAME

(75) Inventor: Kyung Han Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 571 days.

(21) Appl. No.: 12/955,474

(22) Filed: Nov. 29, 2010

(65) Prior Publication Data

US 2011/0126576 A1 Jun. 2, 2011

(30) Foreign Application Priority Data

Nov. 30, 2009 (KR) ..... 10-2009-0116873

(51) Int. Cl.

| | |
|---|---|
| ***F25C 5/18*** | (2006.01) |
| ***F25C 5/02*** | (2006.01) |
| ***F25C 1/22*** | (2006.01) |
| ***F25D 25/00*** | (2006.01) |

(52) U.S. Cl.
USPC ..... 62/344; 62/320; 62/340; 62/377

(58) Field of Classification Search
USPC ..... 62/320, 344, 377; 222/330, 410–413; 198/467.1, 513, 545, 548, 550.6, 198/550.1, 582, 608, 625, 657; 241/DIG. 17
See application file for complete search history.

(56) References Cited

U.S. PATENT DOCUMENTS

| | | | | |
|---|---|---|---|---|
| 4,192,151 | A * | 3/1980 | Carpenter | 62/320 |
| 4,942,983 | A * | 7/1990 | Bradbury | 222/238 |
| 6,442,954 | B1 * | 9/2002 | Shapiro et al. | 62/137 |
| 2007/0204643 | A1 * | 9/2007 | Harris | 62/340 |
| 2008/0156023 | A1 * | 7/2008 | Kim et al. | 62/344 |
| 2012/0036882 | A1 * | 2/2012 | Park et al. | 62/344 |
| 2012/0036883 | A1 * | 2/2012 | Jeong et al. | 62/344 |
| 2012/0096872 | A1 * | 4/2012 | Cheong et al. | 62/3.3 |

FOREIGN PATENT DOCUMENTS

| | | | |
|---|---|---|---|
| JP | 04-062370 | A | 2/1992 |
| KR | 10-2004-0067646 | A | 7/2004 |
| KR | 10-2005-0034337 | A | 4/2005 |
| KR | 10-2005-0041757 | A | 5/2005 |

* cited by examiner

*Primary Examiner* — Frantz Jules
*Assistant Examiner* — Joseph Trpisovsky
(74) *Attorney, Agent, or Firm* — Birch, Stewart, Kolasch & Birch, LLP

(57) ABSTRACT

An ice storage device and a refrigerator and purifier including the ice storage device are disclosed. The ice storage device includes an ice storage box, a plurality of ice outlets provided in the ice storage box and an ice transfer member provided in the ice storage box, to transfer ice to the plurality of the ice outlets selectively. An object of the present invention is to provide an ice storage device capable of discharging ice along various directions, and a refrigerator and purifier including the ice storage device.

14 Claims, 9 Drawing Sheets

(a)

(b)

(a)

(b)

(a)

(b)

ICE STORAGE DEVICE AND REFRIGERATOR INCLUDING THE SAME AND A WATER PURIFIER INCLUDING THE SAME

CROSS REFERENCE TO RELATED APPLICATION

This application claims the benefit of the Patent Korean Application No. 10-2009-0116873, filed on Nov. 30, 2009, which is hereby incorporated by reference as if fully set forth herein.

BACKGROUND OF THE DISCLOSURE

1. Field of the Disclosure

The present invention relates to an ice storage device and a refrigerator and a purifier, which include the same, more specifically, to an ice storage device capable of exhausting ice received in an ice storage box in various direction.

2. Discussion of the Related Art

A refrigerator or purifier which is capable of providing ice includes an icemaker, an ice storage box configured to store ice made by the icemaker and an ice transfer provided in the ice storage box to transfer ice outside.

A conventional ice storage device may include an ice storage box having a predetermined space formed therein, an ice transfer member provided in the ice storage box and an ice outlet provided in a predetermined portion of the ice storage box.

When it is necessary to exhaust ice, the ice transfer member is put into operation to transfer ice to an ice exhausting member. Here, the ice moved by the ice exhausting member may be exhausted outside via a dispenser provided in such a refrigerator or purifier.

However, the ice stored in the conventional ice storage box is configured to be exhausted along only a single direction according to the related art.

As a result, there may arise necessity of ice exhaustion along various direction simultaneously or selectively for a variety of purposes, without exhausting the ice inside the ice storage box outside the refrigerator or purifier, for edible ice formation and driving water cooling by means of the ice.

However, the related art configured to discharge the ice along a single direction has a disadvantage of failure to satisfy such the necessity.

SUMMARY OF THE DISCLOSURE

To solve the problems, an object of the present invention is to provide an ice storage device capable of discharging ice along various directions, and a refrigerator and purifier including the ice storage device.

To achieve these objects and other advantages and in accordance with the purpose of the invention, as embodied and broadly described herein, an ice storage device includes an ice storage box; a plurality of ice outlets provided in the ice storage box; an ice transfer member provided in the ice storage box, to transfer ice to the plurality of the ice outlets selectively.

The plurality of the ice outlets may include a first ice outlet provided in a predetermined portion of the ice storage box; and a second ice outlet provided in the other opposite portion of the ice storage box.

The first ice outlet may be located in opposite to the second ice outlet.

The ice storage device may further include a slope guide part provided inside the ice storage box to guide ice stuck in the ice storage box toward the ice transfer member.

The ice transfer member may be rotatable in a clockwise and counter-clockwise direction, the ice transfer member including a shaft; a transfer part provided in the shaft, the transfer part configured of a spiral blade; and a rotatable opening/closing member provided in the shaft, adjacent to the first ice outlet, to close the ice transferred toward the first ice outlet selectively.

The rotatable opening/closing member is configured of a cylindrical member having a hollow, and a predetermined portion of the rotatable opening/closing member is opened and the other opposite portion thereof is partially opened.

The rotatable opening/closing member comprises a closing wall portion provided in the other opposite portion; and, an open portion provided adjacent to the closing wall portion.

The ice storage device may further include a guide projection projected from a bottom of the ice storage box to prevent the ice transferred by the transfer part from being caught in a circumference of a body portion and to guide the ice to move into the rotatable opening/closing member.

The ice storage device may further include a water drainage hole provided in a bottom of the ice storage box; and a water discharge path connected to the bottom of the ice storage box to discharge the water passing the water drainage hole outside the ice storage box.

The ice storage device may further include an opening/closing unit configured to open and close the ice outlet.

The opening/closing unit may be arranged in the second ice outlet, the opening/closing unit including an opening/closing member rotatably provided in the shaft, to open and close the second ice outlet; a projection projected from an outer circumferential surface of the shaft; and a friction member provided between the projection and the opening/closing member, with surface-contacting with the projection and the opening/closing member to transmit a rotational force generated by the rotation of the shaft to the opening/closing member.

The opening/closing member may be rotated by the frictional force against the friction member when the shaft is rotated in a predetermined first direction, only to open the second ice outlet, and the opening/closing member may be rotated by its self weight when the shaft is rotated in a second direction or when the rotation of the shaft is stopped, only to close the second ice outlet.

The opening/closing unit may be arranged in the second ice outlet, the opening/closing unit including an opening/closing member rotatably provided in the shaft, to open and close the second ice outlet; a shaft gear part provided in an outer circumferential surface of the shaft; and a transmitting gear part engaging with the shaft gear part and with an opening/closing member gear part provided in the opening/closing member, to transmit an operational force of the shaft gear part to the opening/closing member.

The transmitting gear part may include a first transmitting gear part engaging with the shaft gear part; and a second transmitting gear part engaging with the opening/closing member gear part, the second transmitting gear part spaced apart a predetermined distance from the first transmitting gear part and the opening/closing member may further include a damper member provided between the first transmitting gear part and the second transmitting gear part, to surface-contact with the first and second transmitting gear parts to transmit a rotational force of the first transmitting gear part to the second transmitting gear part.

The damper member configured to transmit a rotational force applied to a predetermined surface thereof when rotated in a predetermined direction to the other opposite surface thereof and to prevent a rotational force applied to the other opposite surface thereof when rotated in the other opposite direction from transmitting to the predetermined surface, and the damper member may be configured to transmit a rotational force of the first transmitting gear part generated by the rotation of the shaft to the second transmitting gear part and not to transmit a rotational force of the second transmitting gear part engaging there with, when the opening/closing member is rotated by its self weight, to the first transmitting gear part.

The opening/closing unit may be arranged in the second ice outlet, the opening/closing unit including an opening/closing member rotatably provided in the shaft, to open and close the second ice outlet; an extension connected to the opening/closing member, with a rack gear formed therein; a driving gear part engaging with the rack gear; and a driving motor connected with the driving gear part, to rotate the driving gear part.

The ice storage device may further include a catching protrusion provided in the other opposite portion of the ice storage box, to limit the rotation of the opening/closing member.

In another aspect of the present invention, a refrigerator includes an ice storage box comprising a first ice outlet and a second ice outlet; an ice transfer member rotatable in a clockwise and counter-clockwise direction inside the ice storage box, to transfer ice to one of the first and second ice outlets selectively; and an opening/closing unit connected with the ice transfer member, adjacent to the first ice outlet or the second ice outlet, to open and close one of the first and second ice outlets according to the clockwise direction rotation or counter-clockwise direction rotation of the ice transfer member.

The ice transfer member may be rotatable in the clockwise and counter-clockwise direction inside the ice storage box and the ice transfer member may include a shaft; a transfer part provided in the shaft, the transfer part configured of a spiral blade; and a rotatable opening/closing member provided in the shaft, adjacent to the first ice outlet, to close the ice transferred toward the first ice outlet selectively, and the opening/closing unit may include an opening/closing member rotatably provided in the shaft, to open and close the second ice outlet, the opening/closing member configured to open the second ice outlet with being rotated by a rotational force of the shaft during one of the clockwise or counter-clockwise direction rotation of the shaft and to close the second ice outlet during the other direction rotation of the shaft or while the shaft stops the rotation.

In a further aspect of the present invention, a purifier includes an ice storage box comprising a first ice outlet and a second ice outlet; an ice transfer member rotatable in a clockwise and counter-clockwise direction inside the ice storage box, to transfer ice to one of the first and second ice outlets selectively; and an opening/closing unit connected with the ice transfer member, adjacent to the first ice outlet or the second ice outlet, to open and close one of the first and second ice outlets according to the clockwise direction rotation or counter-clockwise direction rotation of the ice transfer member.

The ice transfer member may be rotatable in the clockwise and counter-clockwise direction inside the ice storage box and the ice transfer member may include a shaft; a transfer part provided in the shaft, the transfer part configured of a spiral blade; and a rotatable opening/closing member provided in the shaft, adjacent to the first ice outlet, to close the ice transferred toward the first ice outlet selectively, and the opening/closing unit may include an opening/closing member rotatably provided in the shaft, to open and close the second ice outlet, the opening/closing member configured to open the second ice outlet, with being rotated by a rotational force of the shaft during one of the clockwise or counter-clockwise direction rotation of the shaft and to close the second ice outlet during the other direction rotation of the shaft or while the shaft stops the rotation.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

As follows, an ice storage device according to an exemplary embodiment of the present invention will be described in reference to the accompanying drawings.

Figure 1:
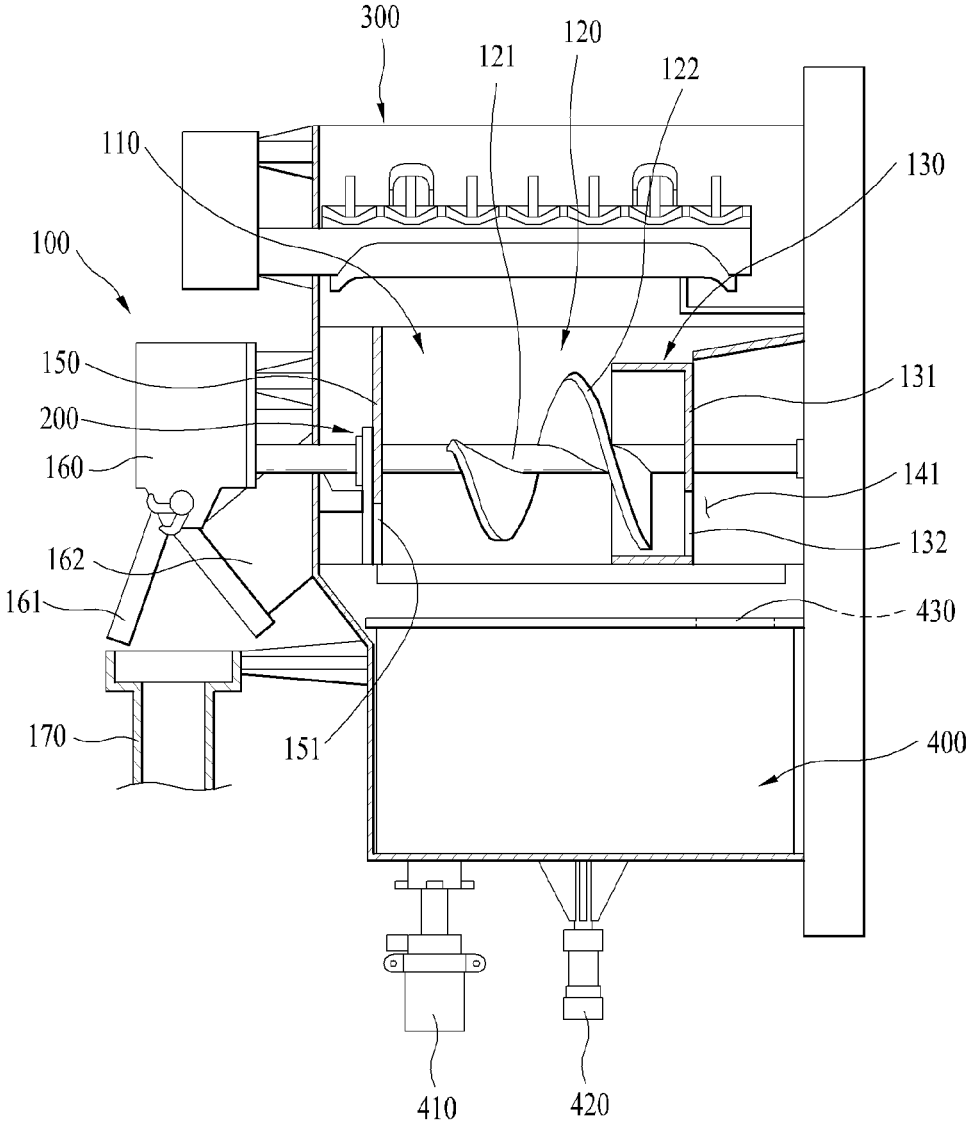
FIG. 1 is a side sectional view illustrating an ice storage device according to the present invention installed in a refrigerator or purifier.

As shown in FIG. 1, an ice storage device 100 according to the embodiment of the present invention includes an ice storage box 110 configured to store ice therein and an ice transfer member 120 provided in the ice storage box 110 to transfer the ice stored in the ice storage box 110.

A driving device 160 configured to rotate the ice transfer member 120 may be provided adjacent to the ice storage box 110.

An ice making device 300 is provided beyond the ice storage device 100 and ice made in the ice making device 300 falls into the ice storage box 110 to be stored therein.

A water storage 400 is provided below the ice storage box 110 and the ice discharged from the ice storage box 110 may fall into the water storage 400. After that, the ice may cool water stored in the water storage 400.

The water storage 400 may be box-shaped. A water supplying pipe 410 and a water exhausting pipe 420 may be connected to a bottom of the water storage 400.

Here, the element provided below the ice storage box 110 is not limited to the water storage 400 and any elements capable of storing objects, which will be cooled by the ice, therein may be installed below the ice storage box 110.

A guide pipe 162 is connected to a predetermined portion of the ice storage box 110 to guide the ice discharged from the ice storage box 110. A guide pipe closing member 161 is provided at an outlet portion of the guide pipe 162 to open and close the guide pipe 162 selectively.

The driving device 160 may drive the guide pipe closing member 161 as well as the ice transfer member 120.

An outlet pipe 170 configured to guide the ice moved along the guide pipe 162 to be discharged toward a dispenser (not shown) may be provided below the guide pipe closing member 161.

A first ice outlet 141 and a second ice outlet 151 may be provided in a predetermined portion and the other opposite portion of the ice storage box 110, respectively. Here, the first ice outlet 141 is selectively opened and closed by a cylindrical-shaped rotatable opening/closing member 130 provided in the ice transfer member 120.

The second ice outlet 151 is formed in the predetermined opposite wall 151 and it is opened and closed by an opening/closing unit 200 provided in the other opposite wall 151.

The ice storage device having the above configuration may be applicable to a purifier having an ice storing function as well as a refrigerator.

Figure 2:
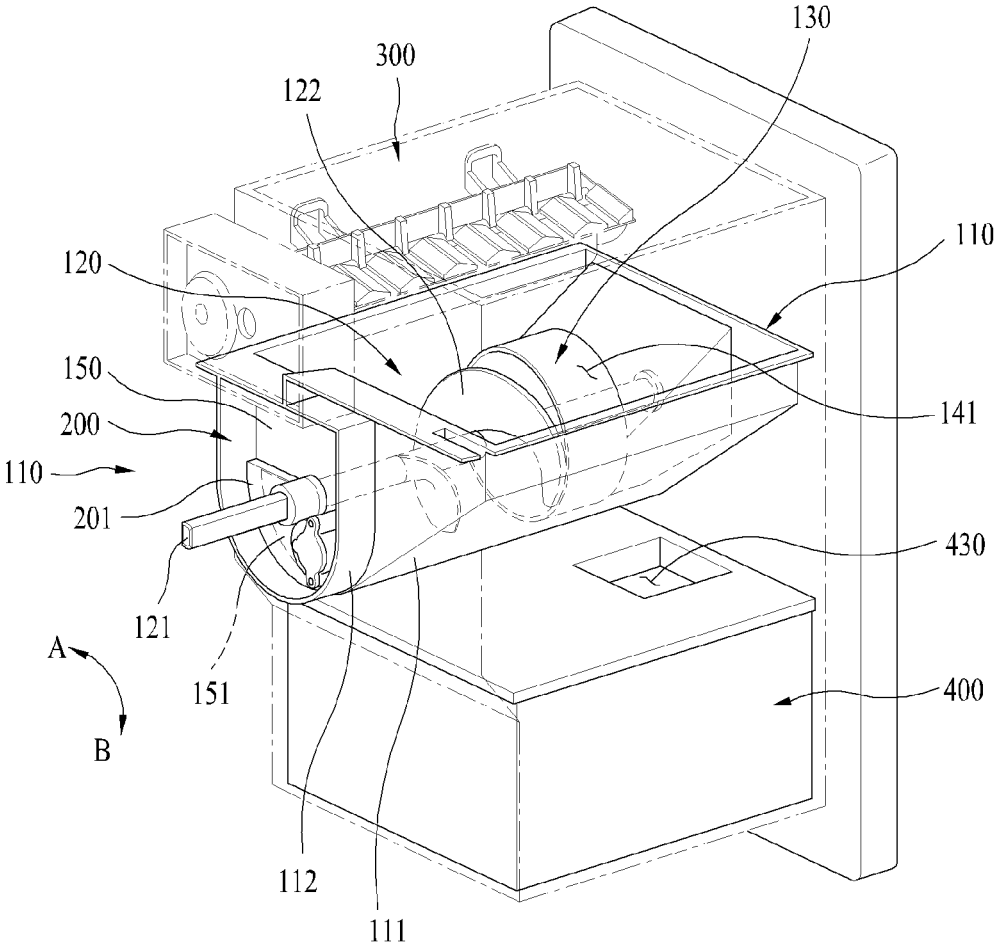
FIG. 2 is a perspective view illustrating the installed ice storage device according to the present invention.

As shown in FIG. 2, the ice storage box 110 has an open top, with the first and second ice outlets 141 and 151 formed therein.

As mentioned above, the ice transfer member 120 is rotatably provided in the ice storage box 110. The ice transfer member 120 includes a shaft 121, the cylindrical shaped-rotatable opening/closing member 130 provided in the shaft 121 and a spiral blade-shaped transfer part 122 provided in an outer circumferential surface of the shaft 121.

The rotatable opening/closing member 130 is installed in the first ice outlet 141. The ice is supposed to be discharged from the first ice outlet 141 periodically whenever the ice transfer member 120 is rotated in a first direction (A direction).

The opening/closing unit 200 is provided in the second ice outlet 141 and the opening/closing unit 200 includes a closable member 201 configured to cover the second ice outlet 151 selectively.

The closable member 201 may selectively open and close the second ice outlet 151 according to the rotation of the shaft 121.

In other words, when the shaft 121 is rotated in a second direction (B direction), the second ice outlet 151 is open.

A rib member 112 configured to surround both of the second ice outlet 151 and the opening/closing unit 200 may be projected outwardly from a predetermined side wall of the ice storage box 110 having the second ice outlet 151 formed therein. The rib member 112 is connected with the guide pipe (162, see FIG. 1) shown in FIG. 1.

Because of that, the ice discharged via the second ice outlet 151 may fall along the guide pipe (162, see FIG. 1) to be discharged via the dispenser (not shown).

A predetermined end of the shaft 121 is projected longitudinally outside the ice storage box 110. Here, the end of the shaft 121 is connected to the driving device (160, see FIG. 1) shown in FIG. 1.

Once the driving device 160 is put into operation, the shaft 121 is rotated and the ice transfer member 120 and the opening/closing unit 200 are put into operation selectively.

The water storage 400 is provided below the ice storage box 110 and it has an inlet 430 formed in a top surface thereof to draw the ice discharged from the first ice outlet 141 therein.

As a result, the ice drawn into the inlet 430 may cool the temperature of the water, with melting in the water stored in the water storage 400.

Such the water may be discharged outside according to a user's command and the user may be supplied cool water rapidly.

Figure 3:
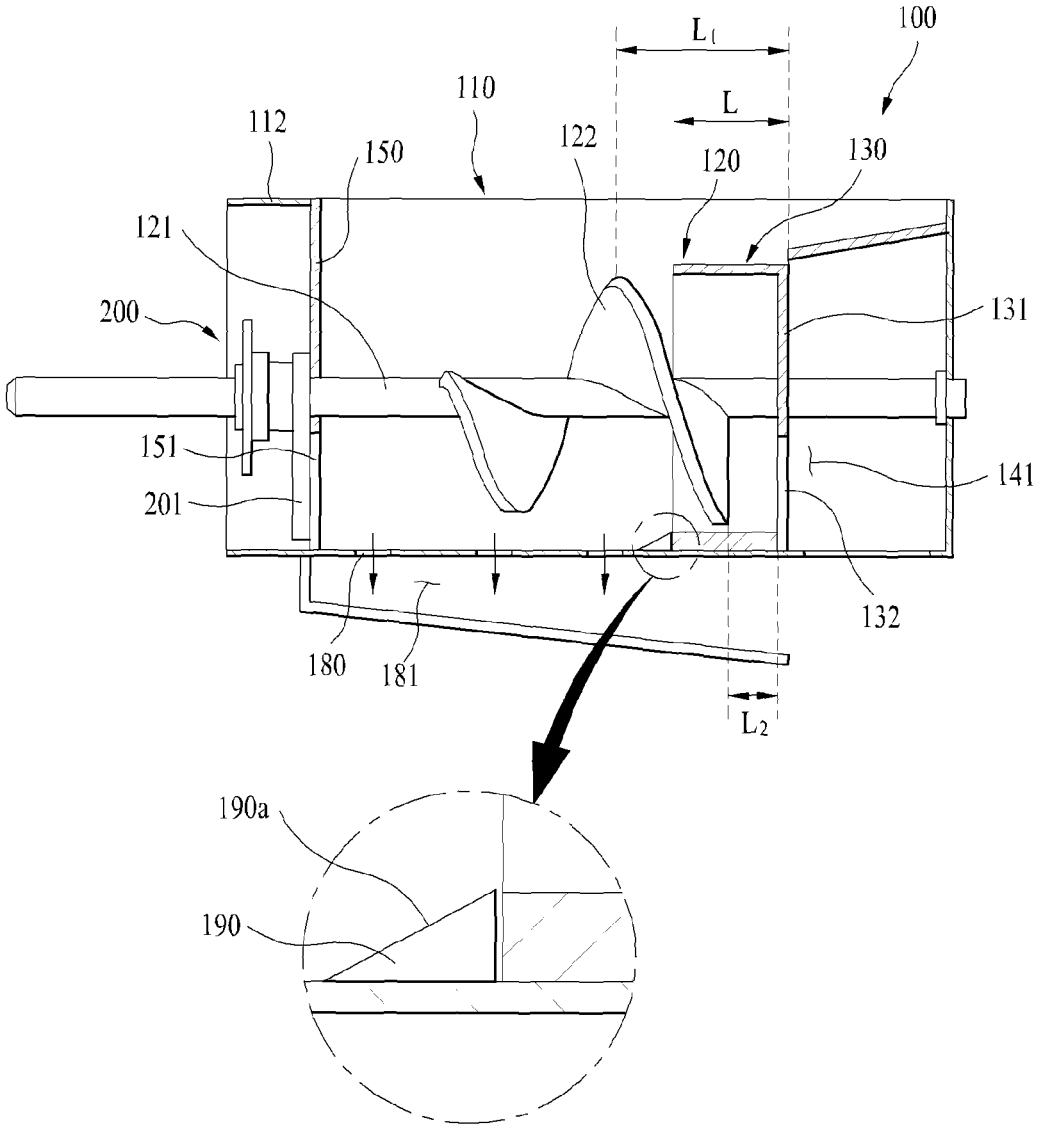
FIG. 3 is a side sectional view illustrating the ice storage device.

As shown in FIG. 3, the first ice outlet 141 is provided in an inner right portion of the ice storage box 110 and the second ice outlet 151 is provided in an inner left portion of the ice storage box 110. The ice transfer member 120 is rotated in a clockwise/counter-clockwise direction to transfer the ice to anywhere to the first ice outlet 141 or the second ice outlet 151, to discharge the ice outside.

For that, the rotatable opening/closing member 130 is provided adjacent to the first ice outlet 141 and the opening/closing unit 200 is provided adjacent to the second ice outlet 151.

The transfer part 122 configured of a spiral blade to surround the shaft 121 may push the ice toward the first ice outlet 141 or toward the second ice outlet 151 along the rotational direction of the shaft 121.

Because of that, the first ice outlet 141 and the second ice outlet 151 may be arranged in an opposite direction.

A plurality of water drainage holes 180 may be formed in a bottom of the ice storage box 110 to allow the water melting from the ice to flow outside, spaced apart a predetermined distance from each other, and a water discharge path 181 is connected to the bottom of the ice storage box 110 to allow the water discharged via the drainage holes 180 to flow there through outside.

Here, the water discharge path 181 may be arranged along the bottom of the ice storage box 110 and also it may be slope enough to discharge the water smoothly.

As a result, the water discharged along the water discharge path 181 may be discharged outside by a drainage device (not shown) provided in the water discharge path 181.

A guide projection 190 is provided in an inner bottom surface of the ice storage box 110 and the guide projection 190 may be adjacent to the rotatable opening/closing member 130 having a cylindrical shape.

The rotatable opening/closing member 130 may be stepped from the bottom of the ice storage box 110 because of its thickness. When such a step is formed, the ice transferred toward the rotatable opening/closing member 130 by the transfer part 122 may be caught in the step and the motion of the ice may be limited.

As a result, the guide projection 190 configured to guide the motion of the ice is necessary to limit the motion of the ice such that the ice may be discharged outside via the first ice outlet 141 after drawn into the rotatable opening/closing member 130 smoothly.

The guide projection 190 has a predetermined height corresponding to the thickness (t) of an outer wall of the rotatable opening/closing member 130 and it includes a slope portion 190*a* to allow the ice to slide over.

Here, the slope portion 190*a* may be slope upward to the rotating opening/closing member 130.

Figure 4:
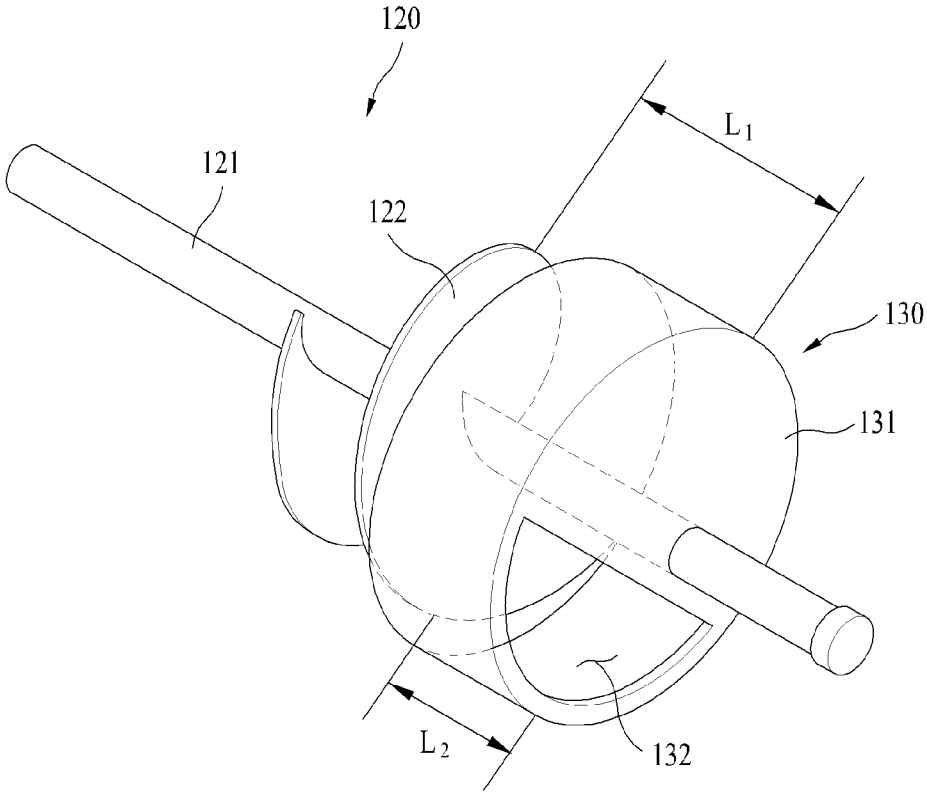
FIG. 4 is a perspective view illustrating an ice transfer member according to the present invention.

As shown in FIG. 4, the rotatable opening/closing member 130 is fixedly coupled to the shaft 121, in a hollow-shape.

The shape of the rotatable opening/closing member may be a cylindrical member having a hollow therein Here, an entire rear portion of the rotatable opening/closing member 130 may be opened and a front portion thereof is partially opened.

The partially open front portion may be arranged toward the first ice outlet (141, see FIG. 3) and the front portion includes a closing wall portion 131 configured to close an inside of the ice storage box 110 from the first ice outlet (141, see FIG. 3) and an open portion 132 configured to allow the first ice outlet to communicate with the inside of the ice storage box.

Here, when the open portion 132 is located high and the closing wall portion 131 is located down, the ice is closed by the closing wall portion 131 not to discharge the ice outside the ice storage box.

As shown in FIGS. 3 and 4, the distance (L2) between the open portion 132 and the transfer part 122 located closest to the open portion 132 may be smaller than the forward and rearward width (L) of the rotatable opening/closing member to allow the ice discharged smoothly when the open portion 132 is located down.

The length of L2 is smaller than the width or length of the ice. Because of that, when the ice is located in L2, the ice may pass the open portion 132 and the first ice outlet (141, see FIG. 3) sequentially.

In the meanwhile, the distance (L1) between the closing wall portion 131 and the transfer part located closest to the closing wall portion 131 is larger than the forward/rearward width (L) of the rotatable opening/closing member 130. Because of that, the ice pushed and transferred by the transfer part 122 may not move until the closing wall portion 131 even when the closing wall portion 131 is located down.

Figure 5:
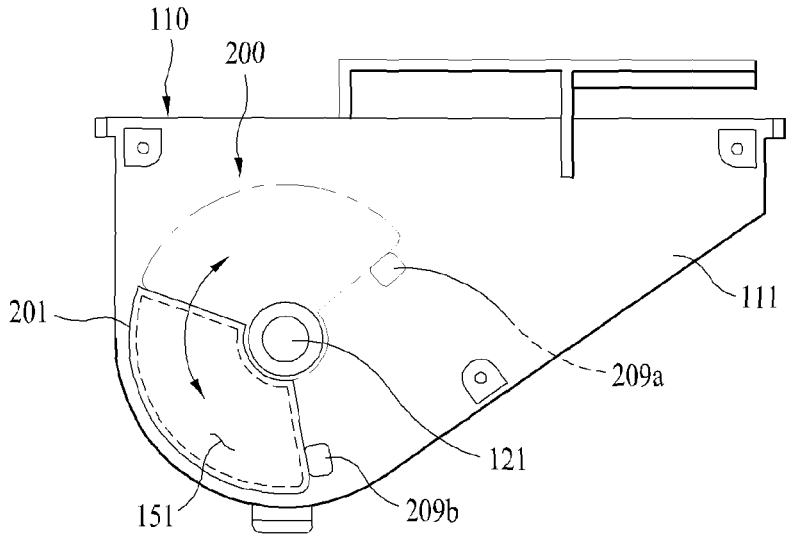
FIGS. 5(*a*) and 5(*b*) are diagrams illustrating an opening/closing unit according to a first embodiment, which is configured to open and close a second ice outlet provided in the ice storage device according to the present invention.
Figure 5:
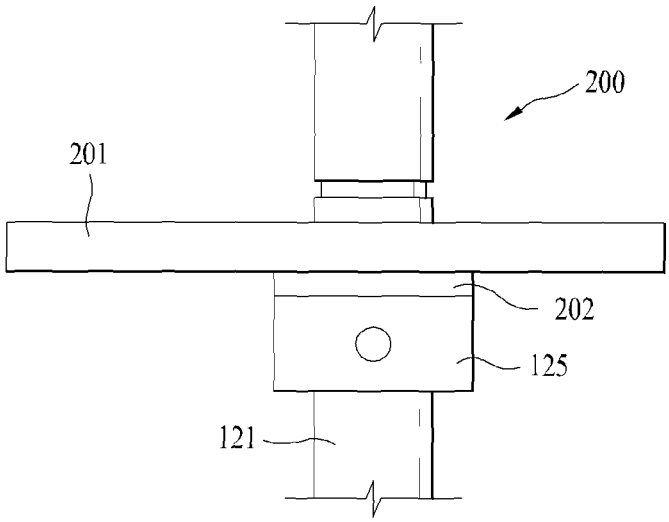
Figure 7:
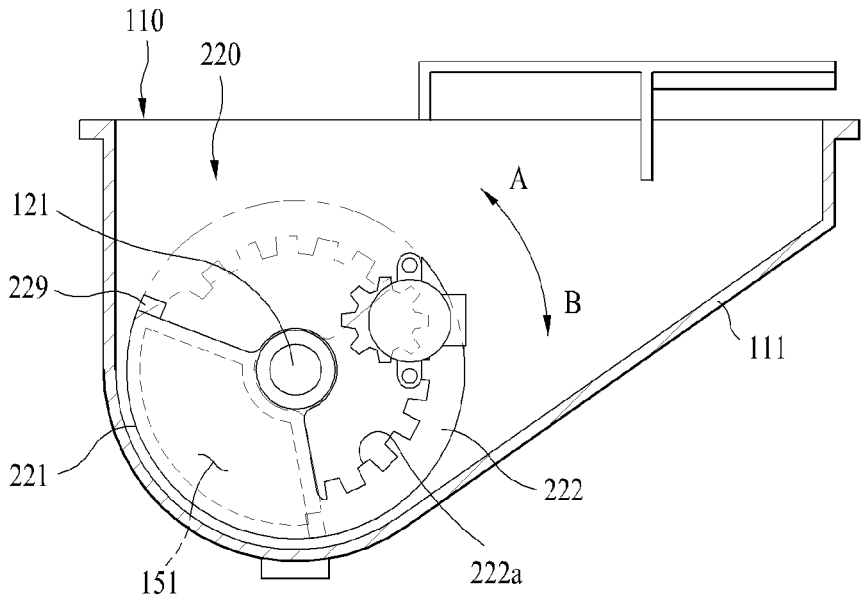
FIGS. 7(*a*) and 7(*b*) are diagrams illustrating the opening/closing unit according to a third embodiment, which is configured to open and close the second ice outlet provided in the ice storage device according to the present invention.
Figure 7:
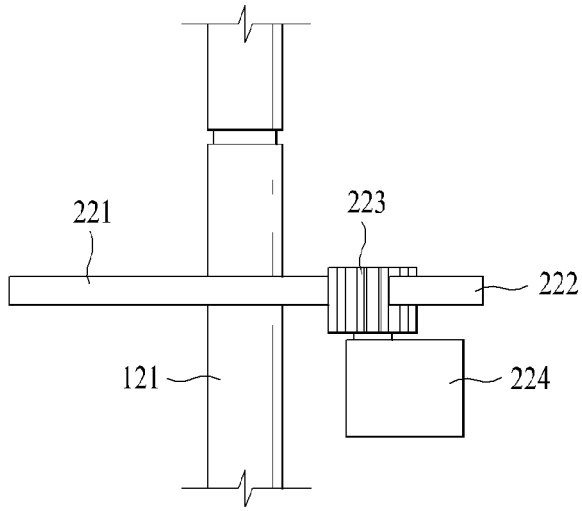

FIGS. 5 and 7 are diagrams illustrating various embodiment of the opening/closing member configured to open and close the second ice outlet 151.

As shown in FIG. 5(*a*), a slope guide part 111 is provided in the ice storage box 110 and the ice falling from the slope guide part 111 may be moved toward the ice transfer member (120, see FIG. 3) by the guide of the slope guide part 111.

The second ice outlet 151 is provided in the ice storage box 110 in a spiral shape and the present invention is not limited to the spiral shape.

The opening/closing unit 200 may be configured to open and close the second ice outlet 151 and it includes an opening/closing member 201 rotatably coupled to the shaft 121 to open and close the second ice outlet 151.

Two catching protrusions 209*a* and 209*b* are provided in side walls of the ice storage box 110 to limit the motion of the opening/closing member 201, respectively.

As shown in FIG. 5(*b*), a projection 125 is outwardly projected from an outer circumferential surface of the shaft 121 and the projection 125 is simultaneously rotated together with the shaft 121 when the shaft 121 is rotated.

The opening/closing member 201 is rotatably provided in the shaft 121 and a friction member 202 is provided between the opening/closing member 201 and the projection 125 to surface-contact with both of them to transmit the rotational force of the shaft 121 to the opening/closing member 201.

Here, when the shaft 121 is rotated in a clockwise direction as shown in FIG. 5(*a*), the projection 125 is rotated together with the shaft 121 and the friction member 202 surface-contacting with the projection 125 is rotated together.

The friction member 202 is in surface-contact with the opening/closing member 201. Because of that, the rotational force of the friction member 202 is transmitted even to the opening/closing member 201 and the frictional force lifts the opening/closing member 201.

As a result, the second ice outlet 151 is open and the ice inside the ice storage box 110 is pushed toward the second ice outlet 151 by the transferring of the ice transfer member (120, see FIG. 3), to be discharged outside the ice storage box 110.

At this time, the lifted opening/closing member 201 is caught by the catching protrusions 209*a* located in an upper portion and the motion of the opening/closing member 201 is limited.

When the shaft 121 is rotated along the clockwise direction continuously in the state of the opening/closing member 201 being caught in the catching protrusion 209*a* located high, both of the projection 125 and the friction member 202 are rotated and then the friction generated between the friction member 202 and the opening/closing member 201 may occur continuously.

However, the frictional force is not so big enough to generate transformation of the catching protrusion 209*a* because of the motion of the opening/closing member 201. Because of that, the opening/closing member 201 may not move any more.

When the rotation of the shaft 121 is stopped, the opening/closing member 201 is moved downward by its self weight and the second ice outlet 151 is then closed.

When the opening/closing member 201 is rotated downwardly, the friction member 202 may be rotated by the opening/closing member 202.

During this rotation, friction is generated between the friction member 202 and the projection 125 and this friction is not so big enough to stop the rotation of the opening/closing member 201. Because of that, the downward motion of the opening/closing member 201 may not be interfered with.

In the meanwhile, the opening/closing member 201 rotated with moving downwardly may be caught in the catching protrusion 209*b* located down to have its motion limited.

If the shaft 121 is rotated in the counter-clockwise direction in the state of the opening/closing member 201 being caught in the catching protrusion 209*a* located high, the opening/closing member 201 may be moved downwardly by the frictional force between the projection 125 and the friction member 201 and the frictional force between this frictional force and the opening/closing member 201.

If the opening/closing member 201 is caught in the catching protrusion 209*b* located down, with being moved downwardly, the downward rotation of the opening/closing member 201 may be limited.

Even if the shaft 121 is rotated in the counter-clockwise direction continuously, the opening/closing member 201 is rotatably coupled to the shaft 212 and the frictional force between the friction member 202 and the opening/closing member 201 is not so big enough to transform the catching protrusion. Because of that, the opening/closing member 201 maintains the contact with the down catching protrusion 209*b* and maintains the closing state of the second ice outlet 151.

Here, the friction member 202 may be configured of a washer-shaped silicon ring or rubber ring.

Figure 6:
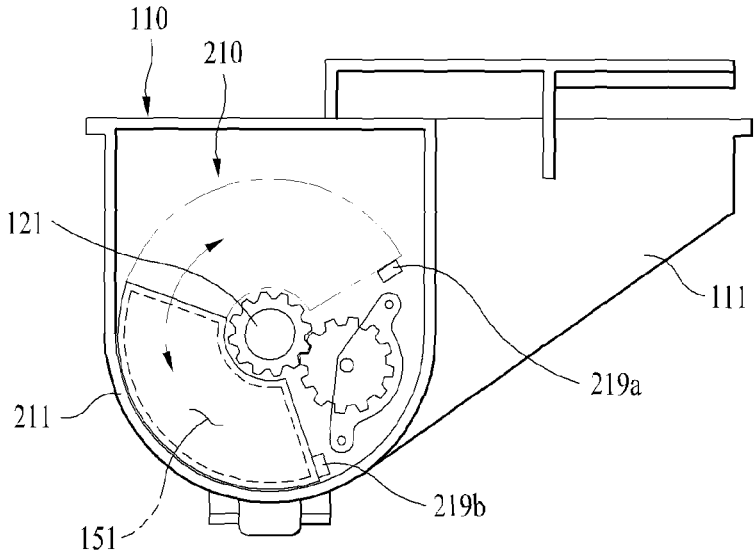
FIGS. 6(*a*) and 6(*b*) are diagrams illustrating the opening/closing unit according to a second embodiment, which is configured to open and close the second ice outlet provided in the ice storage device according to the present invention.
Figure 6:
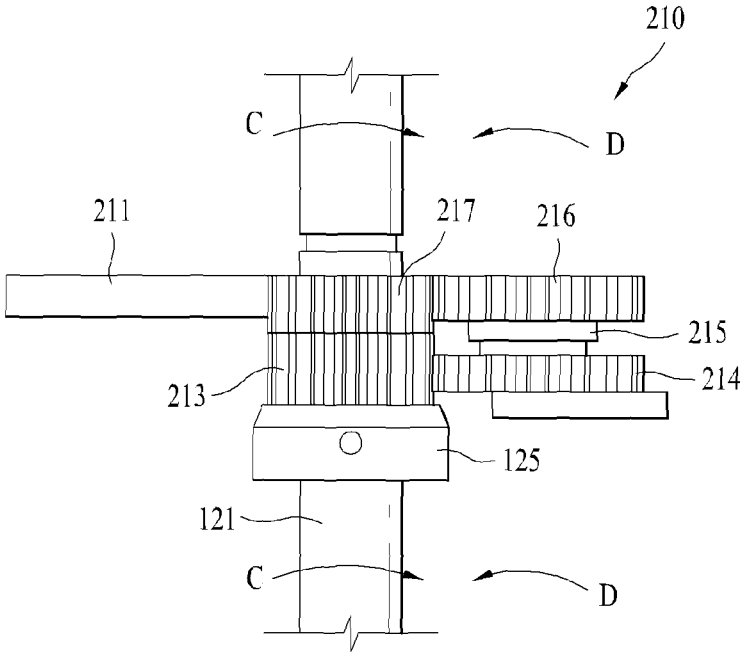

FIG. 6 is a diagram illustrating another embodiment of the opening/closing unit.

As shown in FIG. 6(*a*), a slope guide part 111 is provided in a predetermined portion of the ice storage box 110 to guide the motion of the ice. An opening/closing unit 210 according to this embodiment may be provided in the second ice outlet 151.

According to this embodiment, an opening/closing member 211 of the opening/closing unit 210 may be configured to move upward and downward, while rotating. The upward rotation of the opening/closing member 211 may be limited by an upper catching protrusion 219*a* and the downward rotation of the opening/closing member 211 may be limited by a lower catching protrusion 219*b*.

As shown in FIG. 6(*b*), a projection 125 is projected from an outer circumferential surface of the shaft 212 and a shaft gear part 213 fixedly secured to the shaft 212 may be adjacent to the projection 125.

The shaft gear part 213 may engage with a first transmitting gear part 214 arranged next to the shaft.

Here, a second transmitting gear part 216 may be provided adjacent to the first transmitting gear part 214. A damper member 215 is disposed between the first transmitting gear part 214 and the second transmitting gear part 215.

The damper member 215 may be configured of a fluidal damper member having fluidal material provided therein.

One of characteristics of such the damper member 215 is to transmit a rotational force applied to a predetermined surface thereof to the other opposite surface while rotated in a predetermined direction and another one of them is not to transmit a rotational force applied to the other opposite surface thereof to the predetermined surface while rotated in an opposite direction to the above direction.

This is because resistance of the fluidal material provided within the damper member 215 is generated or not generated along the rotation direction of the damper member 215.

The second transmitting gear part 216 may engage with an opening/closing member gear part 217 provided in the opening/closing member 211 and the opening/closing member gear part 217 is rotatably inserted in the shaft 121.

As a result, when the shaft 121 is rotated in the clockwise direction, that is, 'C' direction shown in the drawings, the shaft gear part 213 may be rotated in the same direction.

The first transmitting gear part 214 engaging with the shaft gear part 213 may be rotated in the counter-clockwise direction, that is, 'D' direction.

The damper member 215 connected with the first transmitting gear part 214 transmits the rotational force of the first transmitting gear part 214 to the second transmitting gear part 216.

Because of that, the second transmitting gear part 216 is also rotated in the counter-clockwise direction, that is, 'D' direction which is the same rotation direction of the first transmitting gear part 214.

The opening/closing member gear part 217 engaging with the second transmitting gear part 216 is rotated by the motional force transmission of the second transmitting gear part 216 in the clockwise direction. Because of that, the opening/closing member 211 may make upward rotation only to open the second ice outlet 151.

When the opening/closing member 211 is rotated, its movement may be limited by the high catching protrusion 219*a* like the first embodiment.

In the meanwhile, the opening/closing member 211 opens the first ice outlet 151 in the state of being caught in the catching protrusion 219*a* located in the upper portion and the shaft 121 is rotated continuously at the same time.

In this case, the first transmitting gear part 214 rotated by the shaft gear part 213 may rotate the damper member 215.

Here, the force transmitted to the second transmitting gear part 216 by the damper member 215 may be strong enough to lift the opening/closing member 21 and not enough to transform the catching protrusion 219*a*.

As a result, in the state of the opening/closing member 211 being caught in the upward catching protrusion 219*a* to stop its motion, the opening/closing member gear part 211 and the second transmitting gear part 216 engaging with the opening/closing member gear part 211 may be stopped.

Here, only the damper member 215 may be rotated in a state of contacting with a side surface of the second transmitting gear part 216.

Since the shaft 121 is rotated continuously, the spiral blade-shaped transfer part (122, see FIG. 3) may transfer the ice toward the second ice outlet 151 continuously and the ice may be discharged outside.

When the rotation of the shaft 121 is stopped, the opening/closing member 211 may rotate downwardly because of the self weight. Because of that, the second transmitting gear part 213 may be rotated in the clockwise direction. This is because the opening/closing member 211 is coupled to the shaft 121 rotatably.

However, the rotational force of the second transmitting gear part 216 may not be transmitted to the first transmitting gear part 214 by the damper member 215. Because of that, the first transmitting gear part 214 may maintain the stand state.

As a result, the rotation of the second transmitting gear part 216 and the rotation of the opening/closing member 217 may be performed smoothly and efficiently.

The opening/closing member 211 rotated, with moving downwardly, may be caught in the catching protrusion 219*a* to stop.

FIGS. 7(*a*) and 7(*b*) illustrate a third embodiment of the opening/closing unit. Here, an opening/closing member 221 of an opening/closing unit 220 according to the third embodiment may be provided to open and close the first ice outlet 151.

An extension 222 extended longitudinally in an arc shape is provided in a predetermined portion of the opening/closing member 221 and a rack gear 222*a* is provided in the extension 222.

The rack gear 222*a* of the extension 222 engages with a driving gear part 223 and the driving gear part 223 is connected with a driving motor 224.

Once the driving motor 224 is put into operation, the driving gear part 223 is rotated and the extension 222 having the rack gear 222*a* formed therein is lifted.

At this time, the opening/closing member 221 is rotated only to open the second ice outlet 151.

Since the opening/closing member 221 is rotatably connected to the shaft 121, the rotation of the opening/closing member 121 will not affect the shaft 121.

In other words, when the driving motor 224 rotates the driving gear part 223 in 'A' direction, both of the extension 222 and the opening/closing member 221 are rotated in 'A' direction, such that the second ice outlet 151 may be open.

When the shaft 121 is rotated in this state, the ice is moved to the second ice outlet 151 by the transfer part (122, see FIG. 3) provided in the shaft 121 to be discharged.

When the second ice outlet 151 has to be closed, the driving motor 224 rotates the driving gear part 223 in 'B' direction and then both of the extension 222 and the opening/closing member 221 are rotated in 'B' direction, too, to close the second ice outlet 151.

A catching protrusion 229 may be provided adjacent to the second ice outlet 151 to limit the rotation of the opening/closing member 221.

When the opening/closing member 221 is caught in the catching protrusion 229 during the closing operation of the second ice outlet 151, the rotation of the opening/closing member 221 may not be performed anymore and the closing state of the second ice outlet 151 may be then maintained.

Here, the driving motor 224 may be installed to an ice making chamber wall configured to define an ice making chamber accommodating the ice storage device (100, see FIG. 1) and the ice making device (300, see FIG. 1).

As follows, the operation of the ice storage device according to the present invention will be described in reference to the accompanying drawings.

Figure 8:
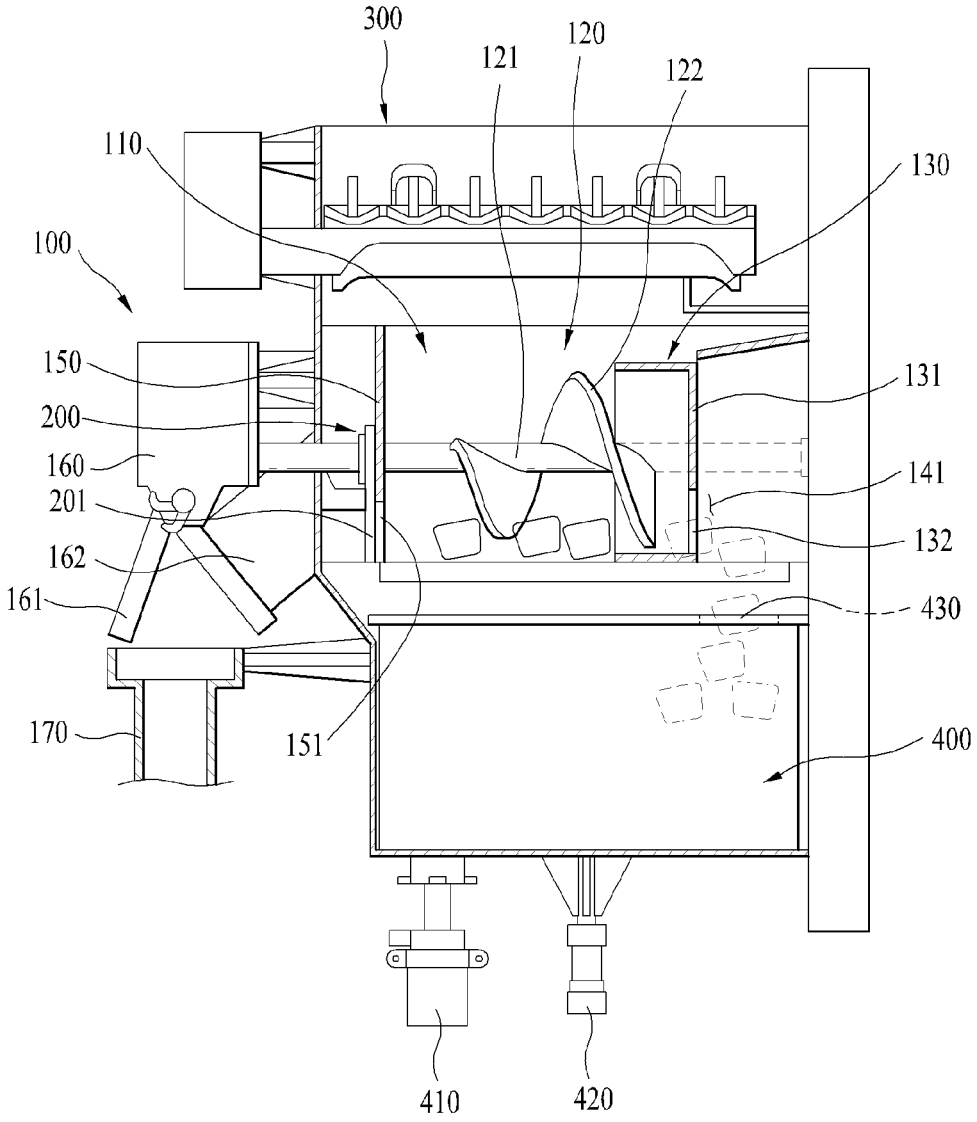
FIG. 8 is a side sectional view illustrating ice discharged from the ice storage device according to the present invention to a first ice outlet.

As shown in FIG. 8, when the ice transfer member 120 is rotated in the predetermined first direction in the state of the ice stored in the ice storage box 110, the spiral blade-shaped transfer part 122 provided in the shaft 121 may transfer the ice rightward.

The ice transferred by the transfer part 122 may be drawn into the rotatable opening/closing member 130 provided in the ice transfer member 120.

The ice drawn into the rotatable opening/closing member 130 may be discharged outside the ice storage box 110 after passing the open portion 132 of the rotatable opening/closing member 130 and the first ice outlet 141.

Hence, the ice is moved to the water storage 400 to cool the water stored in the water storage 400.

At this time, the opening/closing unit 200 provided in the second ice outlet 151 closes the second ice outlet 151 to prevent the ice from being discharged out of the second ice outlet 151.

Simultaneously, the guide pipe opening/closing device 161 also maintains the closing state of the guide pipe 162.

Figure 9:
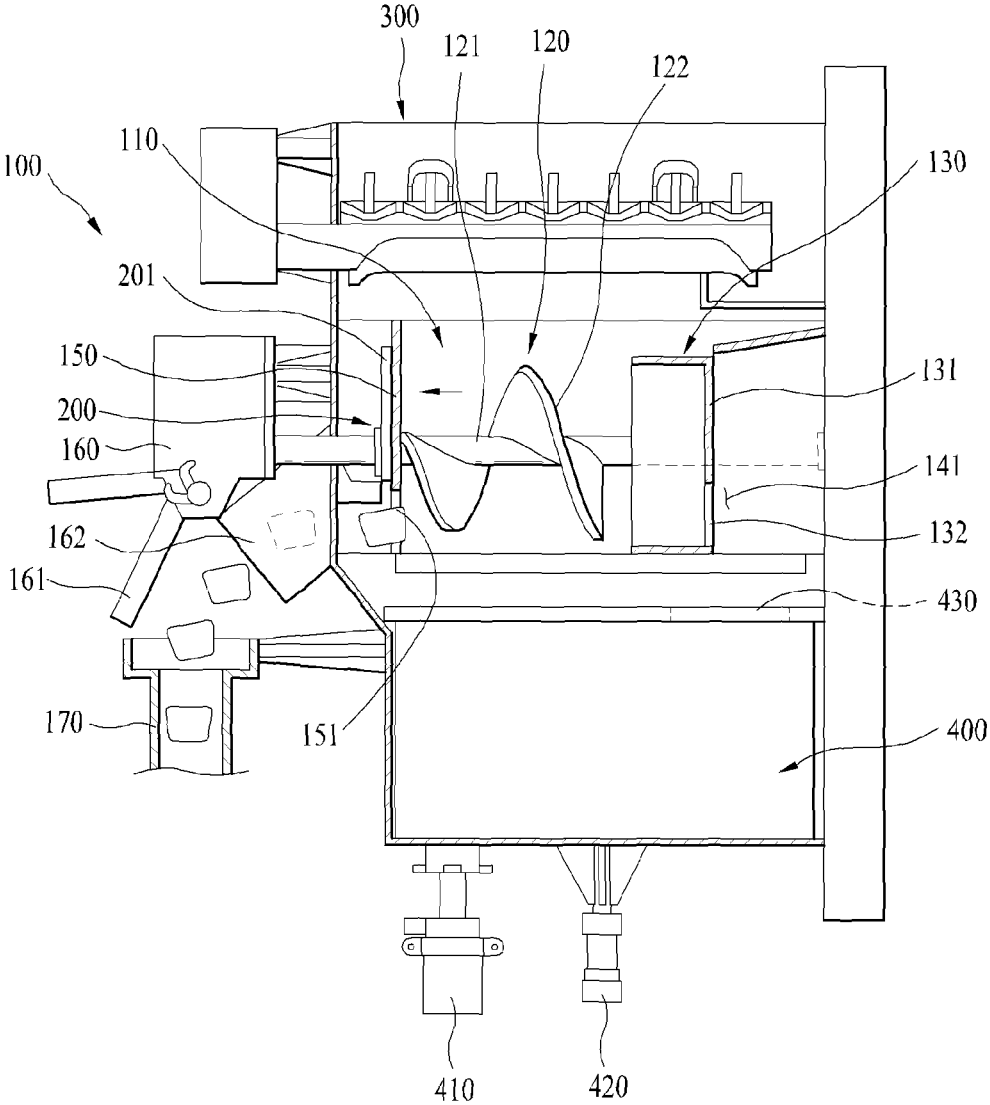
FIG. 9 is a side sectional view illustrating ice discharged from the ice storage device according to the present invention to the second ice outlet.

As shown in FIG. 9, when the ice transfer member 120 is rotated in the second rotational direction, the ice may be transferred toward the second ice outlet 151 by the transfer part 122.

In this case, the opening/closing unit 200 provided in the second ice outlet 151 may open the second ice outlet 151 according to the method shown in FIGS. 5 to 7.

Also, the driving device 160 allows the guide pipe opening/closing device 161 to open the guide pipe 162.

Hence, the ice transferred to the second ice outlet 151 by the transfer part 121 passes the second ice outlet 151.

After that, the ice is moved along the guide pipe 162 and then it is discharged outside via the dispenser after passing the discharging pipe 170.

The present invention has following advantageous effects.

The ice transfer member according to the present invention may transfer ice in a different direction, with being rotated in a clockwise or counter-clockwise direction.

As a result, if it is required to discharge ice outside right away to use the stored ice as it is and if it is required to move ice to other storing objects which have to be cooled rapidly, the ice may be moved to the objects in difference directions, respectively.

The stored ice may be moved in different directions to satisfy difference purposes, respectively. Because of that, user's convenience may be put into operation advantageously.

It will be apparent to those skilled in the art that various modifications and variations can be made in the present invention without departing from the spirit or scope of the invention.

Thus, it is intended that the present invention cover the modifications and variations of this invention provided they come within the scope of the appended claims and their equivalents.

What is claimed is:

1. An ice storage device comprising:

an ice storage box;

a plurality of ice outlets provided in the ice storage box, the plurality of ice outlets including:

a first ice outlet provided in a predetermined portion of the ice storage box; and a second ice outlet provided in the other portion of the ice storage box, the first ice outlet standing opposite to the second ice outlet; and an ice transfer member provided in the ice storage box, to transfer ice to the plurality of the ice outlets selectively, the ice transfer member including:

a shaft rotatable in a clockwise and counter-clockwise direction;

a transfer part provided in the shaft, the transfer part being formed of a spiral blade of which the diameter gradually becomes smaller in one direction;

a first opening/closing unit provided in the shaft adjacent to the first ice outlet, the first opening/closing unit being configured to rotate with the shaft to selectively close the first ice outlet to prevent ice being transferred thereto; and a second/opening closing unit configured to be selectively rotated by the shaft to open and close the second ice outlet.

2. The ice storage device as claimed in claim 1, further comprising:

a slope guide part provided inside the ice storage box to guide ice toward the ice transfer member.

3. The ice storage device as claimed in claim 1 wherein the first opening/closing unit is formed of a cylindrical member having a hollow, and a predetermined portion of the first opening/closing unit is opened and the other opposite portion thereof is partially opened, the first opening/closing unit comprising:

a closing wall portion provided in the other opposite portion; and an open portion provided adjacent to the closing wall portion.

4. The ice storage device as claimed in claim 3, further comprising:

a guide projection projected from a bottom of the ice storage box to prevent the ice transferred by the transfer part from being caught in a circumference of a body of the first opening/closing unit and to guide the ice to move into an inner space of the first rotatable opening/closing unit.

5. The ice storage device as claimed in claim 1, further comprising:

a water drainage hole provided in a bottom of the ice storage box; and a water discharge path provided to the ice storage box to discharge the water passing the water drainage hole outside the ice storage box.

6. The ice storage device as claimed in claim 1, wherein the second opening/closing unit is arranged in the second ice outlet, the second opening/closing unit comprising:

an opening/closing member rotatably provided in the shaft, to open and close the second ice outlet;

a projection projected from an outer circumferential surface of the shaft; and a friction member provided between the projection and the opening/closing member, with surface-contacting with the projection and the opening/closing member to transmit a rotational force generated by the rotation of the shaft to the opening/closing member.

7. The ice storage device as claimed in claim 6, wherein the opening/closing member is rotated by the frictional force against the friction member when the shaft is rotated in a predetermined first direction, only to open the second ice outlet, and the opening/closing member is rotated in a second direction when the shaft is rotated in the second direction or by its self weight when the rotation of the shaft is stopped, only to close the second ice outlet.

8. The ice storage device as claimed in claim 1, wherein the second opening/closing unit is arranged in the second ice outlet, the second opening/closing unit comprising:

an opening/closing member rotatably provided in the shaft, to open and close the second ice outlet;

a shaft gear part provided in an outer circumferential surface of the shaft; and a transmitting gear part engaging with the shaft gear part and with an opening/closing member gear part provided in the opening/closing member, to transmit an operational force of the shaft gear part to the opening/closing member.

9. The ice storage device as claimed in claim 8, wherein the transmitting gear part comprises, a first transmitting gear part engaging with the shaft gear part; and a second transmitting gear part engaging with the opening/closing member gear part, the second transmitting gear part spaced apart a predetermined distance from the first transmitting gear part, the opening/closing member further comprising:

a damper member provided between the first transmitting gear part and the second transmitting gear part, to surface-contact with the first and second transmitting gear parts to transmit a rotational force of the first transmitting gear part to the second transmitting gear part.

10. The ice storage device as claimed in claim 9, wherein the damper member is configured to transmit a rotational force applied to a predetermined surface thereof when rotated in a predetermined direction to the other opposite surface thereof and to prevent a rotational force applied to the other opposite surface thereof when rotated in the other opposite direction from transmitting to the predetermined surface, and the damper member is configured to transmit a rotational force of the first transmitting gear part generated by the rotation of the shaft to the second transmitting gear part and not to transmit a rotational force of the second transmitting gear part engaging there with, when the opening/closing member is rotated by its self weight, to the first transmitting gear part.

11. The ice storage device as claimed in claim 1, wherein the second opening/closing unit is arranged in the second ice outlet, the second opening/closing unit comprising:

an opening/closing member rotatably provided in the shaft, to open and close the second ice outlet;

an extension connected to the opening/closing member, with a rack gear formed therein;

a driving gear part engaging with the rack gear; and a driving motor connected with the driving gear part, to rotate the driving gear part.

12. The ice storage device as claimed in claim 6, further comprising:

a catching protrusion provided in the other opposite portion of the ice storage box, to limit the rotation of the opening/closing member.

13. A refrigerator comprising:

an ice storage box comprising a first ice outlet and a second ice outlet; and an ice transfer member rotatable in a clockwise and counter-clockwise direction inside the ice storage box, to transfer ice to one of the first and second ice outlets selectively, the ice transfer member including:

a shaft rotatable in a clockwise and counter-clockwise direction;

a transfer part provided in the shaft, the transfer part being formed of a spiral blade of which the diameter gradually becomes smaller in one direction;

a first opening/closing unit provided in the shaft adjacent to the first ice outlet, the first opening/closing unit being configured to rotate with the shaft to selectively close the first ice outlet to prevent ice being transferred thereto; and a second/opening closing unit configured to be selectively rotated by the shaft to open and close the second ice outlet.

14. A purifier comprising:

an ice storage box comprising a first ice outlet and a second ice outlet; and an ice transfer member rotatable in a clockwise and counter-clockwise direction inside the ice storage box, to transfer ice to one of the first and second ice outlets selectively, the ice transfer member including:

a shaft rotatable in a clockwise and counter-clockwise direction;

a transfer part provided in the shaft, the transfer part being formed of a spiral blade of which the diameter gradually becomes smaller in one direction;

a first opening/closing unit provided in the shaft adjacent to the first ice outlet, the first opening/closing unit being configured to rotate with the shaft to selectively close the first ice outlet to prevent ice being transferred thereto; and a second/opening closing unit configured to be selectively rotated by the shaft to open and close the second ice outlet.

* * * * *